United States Patent [19]

Tadokoro et al.

[11] 4,108,739

[45] Aug. 22, 1978

[54] PLATING METHOD FOR MEMORY ELEMENTS

[75] Inventors: Eiichi Tadokoro; Tatsuji Kitamoto, both of Odawara, Japan

[73] Assignee: Fuji Photo Film Co., Ltd., Minami Ashigara, Japan

[21] Appl. No.: 786,926

[22] Filed: Apr. 12, 1977

Related U.S. Application Data

[63] Continuation of Ser. No. 579,162, May 20, 1975, abandoned, which is a continuation-in-part of Ser. No. 503,205, Sep. 4, 1974, abandoned.

[30] Foreign Application Priority Data

Sep. 4, 1973 [JP] Japan ..... 48-99641

[51] Int. Cl.[2] ..... C25D 3/56; C25D 5/10; C25D 5/14

[52] U.S. Cl. ..... 204/40; 204/DIG. 9; 204/43 P

[58] Field of Search ..... 204/DIG. 9, 40, 41, 204/43 T, 43 N, 43 P, 44; 340/174 QA

[56] References Cited

U.S. PATENT DOCUMENTS

| | | | |
|---|---|---|---|
| 2,453,668 | 11/1948 | Marisic et al. | 204/40 X |
| 3,480,522 | 11/1969 | Brownlow | 204/40 |
| 3,802,854 | 4/1974 | Mueller-Dittmann et al. | 29/195 |

FOREIGN PATENT DOCUMENTS

| | | | |
|---|---|---|---|
| 2,007,304 | 1/1970 | France | 204/40 |
| 1,136,491 | 12/1968 | United Kingdom | 204/40 |
| 1,210,270 | 10/1970 | United Kingdom | 204/40 |

*Primary Examiner*—G. L. Kaplan
*Attorney, Agent, or Firm*—Sughrue, Rothwell, Mion, Zinn and Macpeak

[57] ABSTRACT

A method for electroplating in a single electroplating bath comprising varying the electric current density so that a non-magnetic plated film and a ferromagnetic plated film are selectively deposited. To achieve this effect the electroplating bath must contain at least about 1 g/l $NaH_2PO_2.H_2O$.

4 Claims, No Drawings

PLATING METHOD FOR MEMORY ELEMENTS

CROSS REFERENCE TO RELATED APPLICATION

This is a continuation of application Ser. No. 579,162, filed May 20, 1975, which in turn was a continuation-in-part of application Ser. No. 503,205, filed Sept. 4, 1974, both now abandoned.

BACKGROUND OF THE INVENTION

1. Field of the Invention

This invention relates to an electroplating method, and more precisely, to a method for electroplating in a single electroplating bath comprising varying the plating conditions so that a non-magnetic plated film and a ferromagnetic plated film are selectively deposited.

2. Description of the Prior Art

In conventional memory elements having a ferromagnetic thin film, some elements are composed of a ferromagnetic film deposited on a non-magnetic base and other elements additionally have a protective non-magnetic film superplated on the ferromagnetic film. Representative examples of such memory elements are magnetic discs for video slow-motion and for stationary image reproduction, and magnetic heads.

Conventional processes for producing these elements having a non-magnetic film and a ferromagnetic film include the following steps.

In the step for forming a non-magnetic film, a non-magnetic plating bath (such as a copper plating bath, a zinc plating bath, a chromium plating bath or a gold plating bath) is used, and thereafter a non-magnetic plated film is formed using this non-magnetic plating bath. Analogously, in the step for forming a ferromagnetic plated film, a ferromagnetic plating bath (such as a nickel plating bath, a cobalt plating bath or a nickel-cobalt alloy plating bath) is used, and thereafter a ferromagnetic plated film is formed.

However, these conventional plating processes have the following defects.

1. For obtaining a non-magnetic plated film and a ferromagnetic plated film, plural plating baths, each corresponding to the films to be formed, are necessary, that is, a plurality of plating baths are required.

2. In any of the processes comprising a non-magnetic plating step followed by a ferromagnetic plating step or vice-versa, the article to be plated must be transferred from a first plating bath to a second plating bath. Accordingly, unneeded apparatus for transferring the article and loss of plating time are inevitable.

3. A washing step with water is necessary each time when the plating is carried out in a different plating bath for the purpose of preventing intermixing of one plating solution in the other plating bath, and much time is required to complete the entire plating procedure.

U.S. Pat. No. 2,453,668 Marisic et al discloses an electrodeposition process for removing pin-holes to improve the luster of an electrodeposited film. There is no description in the patent of a plating method which enables one to obtain magnetic or non-magnetic properties in an electrodeposited film.

British Pat. No. 1,136,491 discloses electroplating magnetic film at, for example, a current density of $0.68A/dm^2$.

British Pat. No. 1,210,270 discloses that the composition of an electroplated layer can be altered by changing plating conditions.

French Pat. No. 2,007,304 discloses, inter alia, a process for forming a permalloy magnetic layer having a low Hc value.

As described above, these conventional plating processes have numerous defects. In an effort to overcome these defects, extensive investigation of the various fundamental phenomena in electroplating has been conducted and the present invention has been achieved.

SUMMARY OF THE INVENTION

Accordingly, an object of this invention is to provide a plating method capable of being carried out in a single plating bath, wherein both a non-magnetic plate film and a ferromagnetic plate film are selectively deposited by varying the plating conditions.

This invention accordingly provides a method for electroplating in a single electroplating bath comprising varying the electric current density in the plating from about $0.3A/dm^2$ to about $10A/dm^2$ so that a non-magnetic film is selectively deposited when the electric current density ranges from about $0.3A/dm^2$ to about $1.5A/dm^2$ and a ferromagnetic film is selectively deposited when the electric current density ranges from about $0.8A/dm^2$ to about $10A/dm^2$.

DETAILED DESCRIPTION OF THE INVENTION

The plating bath used in the method of this invention contains the salts of the ferromagnetic metals cobalt and/or nickel, e.g., NiP, Co-P, Ni-Co-P, and at least one of copper, zinc, chromium, gold and tin as an additional component. This plating bath has the characteristic that the magnetic character of a plated film deposited extensively varies, depending upon the plating conditions. There are many plating baths in which cobalt salts or nickel salts are used, but nickel salts are more often used, for example, Ni-P plating baths. Any water-soluble salt of Co and/or Ni can be used which does not interfere with the plating reaction. A suitable amount of nickel ion in the plating bath can range from about 1 to 300 g/l, and of cobalt ion in the plating bath can range from about 1 to 300 g/l. The amount of $NaH_2PO_2.H_2O$ in the plating bath can suitably range from about 1 to 100 g/l, and must be present in an amount in excess of about 1 g/l for selective electrodeposition to take place, as the results of Example 6 make clear.

Suitable base metals to be plated using such a plating bath having the above-described characteristics are various non-magnetic metals such as copper, zinc and tin, and the plating method of this invention can be applied to any metals. Suitable plating bath compositions are given below for illustration only and the invention is not to be construed as being limited thereby.

Cu Plating Baths $CuSO_4.5H_2O$: about 1 to 300 g/l
$H_2SO_4$: about 5 to 30 cc/l
A suitable anode is a copper plate anode.

Zn Plating Baths $ZnSO_4$: about 1 to 300 g/l
$H_2SO_4$: about 5 to 30 cc/l
A suitable anode is a zinc plate anode.

Sn Plating Baths $SnSO_4$: about 1 to 300 g/l
$H_2SO_4$: about 1 to 30 cc/l
A suitable anode is a tin plate anode.

When plating a base metal such as copper, zinc or tin with this kind of plating bath, variation of the plating conditions is particularly necessary for selectively obtaining a non-magnetic film and a ferromagnetic film. The plating condition parameters in an electroplating of concern are how to charge the plating bath with electricity, the electric current density of the plating bath, the temperature of the plating bath, whether or not the plating bath is stirred, the degree of the stirring, the time for plating, etc., when the plating bath is kept constant.

By varying these parameters, it is possible to selectively deposit both a non-magnetic film and a ferromagnetic film in the same bath. As a result of experiments varying these parameters, it was confirmed that the variation of the electric current density is effective in any plating bath for selectively depositing a non-magnetic film and a ferromagnetic film. In general, when the electric current density is high, a ferromagnetic film tends to be deposited and when the electric current density is low, a non-magnetic film tends to be deposited. Generally, to obtain distinct non-magnetic and ferromagnetic layers, the current density is rapidly changed from the "non-magnetic" film-producing current density to the "ferromagnetic" film-producing current density. Alternatively, the current density can be gradually cycled between the "non-magnetic" film-producing current density and the "ferromagnetic" film-producing current density, in which case a gradient will exist between maximum non-magnetic areas and maximum ferromagnetic areas.

For practical purposes, however, it is generally preferred that the current density be varied from the current density which permits a non-magnetic film to be obtained to the current density which permits a ferromagnetic film to be obtained rather quickly, and such can be accomplished with any conventional switching means.

It is difficult to selectively obtain these films by varying the temperature of a plating bath. In addition, variation of the temperature is not so effective because the plating bath temperature must be necessarily always varied. The charge of the plating bath with electricity can be by using a pulse charge method where pulses of electric current are used and a PR method where the polarity of the current applied to the anode and cathode is alternated.

On these grounds, it was confirmed that the variation of the electric current density during plating and the variation of the manner of electrical charging are effective for the variation of the plating condition for the selective deposition of a non-magnetic film and a ferromagnetic film.

It will be seen from the hereto offered disclosure that the current density range to obtain non-magnetic films is from about 0.3A/dm$^2$ to about 1.5A/dm$^2$ and the range to obtain ferromagnetic films is from about 0.8A/dm$^2$ to about 10A/dm$^2$, and that seemingly these ranges overlap. This overlap is due to the fact that the present invention is not limited to one single plating bath, rather, plating baths of various compositions can be used. Accordingly, the overlap in the plating density ranges is brought about by the fact that these plating density ranges are inclusive of all plating bath compositions which can be used in accordance with the present invention. If one selects one single plating bath, i.e., the composition of the plating bath is fixed, the electric current density to deposit a nonmagnetic layer and the electric current density to deposit a ferromagnetic layer would be fixed and, of course, mutually exclusive.

For example, assume the maximum current density for providing a distinct non-magnetic layer for composition A is 0.8A/dm$^2$ and for composition B is 1.5A/dm$^2$. Below these respective values a non-magnetic film will be obtained and above these respective values a ferromagnetic film will be obtained. It is easily seen that for compositions intermediate composition A and B, the "cut-off point" for obtaining a non-magnetic film and a ferromagnetic film will vary between a current density of 0.8 to 1.5A/dm$^2$. Accordingly, for applicants to claim compositions from A to B, a seeming overlap occurs; however, for any one set composition there is no overlap, i.e., the current density for obtaining a non-magnetic film and the current density for obtaining a ferromagnetic film are exclusive.

In the plating bath which can be used in this invention to obtain both a ferromagnetic plated film and a non-magnetic plated base the pH of the plating bath can range from about 2 to 6. A suitable temperature ranges from about 10° to 70° C. Suitable electrodes which can be used are a nickel anode plate having a purity of more than 99.9% where a nickel plating bath is used and a platinum or rhodium plated tin or zinc plate anode where a cobalt plating bath is used. Suitable plating techniques which can be employed are described in U.S. Pat. Nos. 2,644,787; 3,152,974; 3,227,635; 3,578,571 and 3,637,471.

In order to selectively deposit a non-magnetic film and a magnetic film in one plating bath, it is important to appropriately control the particle size of the plated film to be deposited, by appropriately varying the plating conditions (see, e.g., "Transactions of the Electrochemical Society", 97, 99 (1950) by C. A. Snarely and C. L. Faust).

The sizes of the particles of the ferromagnetic film deposited range from about 500Å to 0.1 $\mu$ or so, and the particle sizes of a non-magnetic film deposited are about 100 Å to 0.1 $\mu$ or so. These are generalizations, and it is difficult to specify the range of these particle sizes with great particularly since they will vary somewhat depending upon the composition of the plating bath.

Important factors for defining the sizes of the particles deposited are the composition of the plating bath and an electric current density in plating. Depending upon the composition of the plating bath, the electric current density in plating of a non-magnetic film and a ferromagnetic film is varied, and, when the electric current density is low, a non-magnetic film is deposited, and when the electric current density is high, a ferromagnetic film is deposited.

In this case, the electric current density ranges from about 0.3A/dm$^2$ to 10A/dm$^2$, and more precisely, in the deposition of a non-magnetic film the electric current density ranges from about 0.3A/dm$^2$ to 1.5A/cm$^2$ or so, and in the deposition of a ferromagnetic film, the density ranges from about 0.8A/dm$^2$ to 10A/dm$^2$ preferably 0.8A/dm$^2$ to 4A/dm$^2$ or so. These are also merely generalizations, and it is difficult to specify the range of the electric current density with great particularity because the density will vary somewhat depending upon the composition of the plating bath and size of the particles to be deposited.

An example of a nickel plating bath which can be suitably used is set forth below.

$NiSO_4.6H_2O$: 10 – 30 g $NiCl_2.6H_2O$: 5 – 15 g $H_3BO_3$: 5 - 20 g
$NaH_2PO_2.2H_2O$: 1.0 - 20 g
pure water: 1l
Current density: 0.1 - 10A/dm$^2$
Temperature: 10° - 40° C Determination of whether the plated film is a non-magnetic film or a ferromagnetic film is by the presence of a saturation magnetization (Bm) in an hysteresis curve obtained with a B-H tracer. The size of the sample of the plated film used in this determination is 1 cm$^2$ and the thickness of the sample is 0.05 to 0.1$\mu$.

Various kinds of electrodes such as a nickel electrode, copper plate anode, a zinc plate anode, a platinum or rhodium plated (about 0.1 to 0.5 microns in thickness), copper or tin plate anode, can be used in plating, and in particular a nickel electrode is preferred when the plating bath is a nickel system.

As is apparent from the above explanation, the method of this invention is completely free from the defects of conventional plating processes. More precisely, conventional plating processes indispensably require a plurality of plating baths for obtaining a non-magnetic film and a ferromagnetic film, and all defects of the conventional processes result from the necessity for plural plating baths. However, in the method of this invention, it is possible to selectively obtain both a non-magnetic plated film and a ferromagnetic plated film in one plating bath, as explained in detail below. Thus, all of the defects in conventional processes are overcome in this invention.

This invention is explained in greater detail in the following Examples. One skilled in the art can easily understand that the components, the proportions thereof and the order of steps can be optionally changed as far as these changes do not overlap the scope of this invention. The present invention is not to be construed as being limited to only the illustrated Examples. In the Examples, unless otherwise indicated, all parts, percents, ratios and the like are by weight.

EXAMPLE 1

Using a plating bath containing the components given in the following Table 1, the bath being provided with a nickel plate anode (nickel purity; 99.9%), a copper plate base substrate (copper purity: 99.9%), which was previously confirmed to be non-magnetic using a B-H tracer, was plated by varying the electric current density during the plating.

TABLE 1

| | | |
|---|---|---|
| Composition | | |
| | $NiSO_4 . 7H_2O$ | 300 g |
| | $NiCl_2 . 6H_2O$ | 50 g |
| | $H_3BO_3$ | 40 g |
| | $NaH_2PO_2 . 2H_2O$ | 14 g |
| | Pure Water | 1000 cc |
| Bath Conditions | | |
| | Plating Bath Temperature | 45° ± 5° C |
| | pH | 4.6 ± 0.4 |

The plating conditions and the results obtained are given in the following Table 2.

TABLE 2

| | | Sample | | | | | |
|---|---|---|---|---|---|---|---|
| | | 1 | 2 | 3 | 4 | 5 | 6 |
| Plating Conditions: | Electric Current Density (A/dm$^2$) | 0.5 | 1.2 | 1.5 | 2 | 3 | 3.2 |
| | Plating Time (sec) | 60 | 40 | 40 | 40 | 40 | 25 |
| Existence of Magnetic Character | | x | x | o | o | o | o |
| Coercive Force: Hc (Oe) | | — | — | 5 | 40 | 80 | 74 |

TABLE 2-continued

| | Sample | | | | | |
|---|---|---|---|---|---|---|
| | 1 | 2 | 3 | 4 | 5 | 6 |
| Squareness Ratio: SQ (Br/Bs) | — | — | 0.82 | 0.78 | 0.67 | 0.80 |

Note
o : ferromagnetic
x: non-magnetic

From the results contained in Table 2, it can be understood that in this plating bath, when the electric current density was 1.5A/dm$^2$ or more, a ferromagnetic plate film was deposited, and when the electric current density was 1.2A/dm$^2$ or less, a non-magnetic plate film was deposited.

The saturation magnetization value of the ferromagnetic plate film obtained was 5800 G/cc, and it was confirmed that the film is an excellent nickel plated film having a saturation magnetization value which approximates that of nickel per se.

EXAMPLE 2

Using a plating bath containing the components given in the following Table 3, the bath being provided with a nickel plate anode (nickel purity: 99.9%), a zinc substrate (zinc purity: 99.9%), which was previously confirmed to be non-magnetic using a B-H tracer, was plated by varying the electric current density and the plating time.

TABLE 3

| | | |
|---|---|---|
| Composition | | |
| | $NiSO_4 . 7H_2O$ | 230 g |
| | $NiCl_2 . 6H_2O$ | 45 g |
| | $H_3BO_3$ | 40 g |
| | $NaH_2PO_2 . 2H_2O$ | 4 g |
| | Pure Water | 1000 cc |
| Bath Condition | | |
| | Plating Bath Temperature | 50° ± 4° C |
| | pH | 4.8 ± 0.4 |

The plating conditions and the results obtained are given in the following Table 4.

TABLE 4

| | | Sample | | | | | |
|---|---|---|---|---|---|---|---|
| | | 7 | 8 | 9 | 10 | 11 | 12 |
| Plating Conditions: | Electric Current Density (A/dm$^2$) | 0.4 | 0.5 | 0.6 | 0.8 | 1.2 | 3.0 |
| | Plating Time (sec) | 60 | 60 | 60 | 90 | 90 | 40 |
| Existence of Magnetic Character | | x | x | x | o | o | o |
| Coercive Force: Hc (Oe) | | — | — | — | 60 | 124 | 84 |
| Squareness Ratio: SQ (Br/Bs) | | — | — | — | 0.82 | 0.78 | 0.87 |

From the results contained in Table 4, it can be understood that in this plating bath, non-magnetic plated film and ferromagnetic plated films were obtained when the electric current density was 0.6A/dm$^2$ or less and 0.8A/dm$^2$ or more, respectively.

EXAMPLE 3

Using a plating bath containing the components given in the following Table 5, a copper base plate was plated in the same manner as described in Examples 1 and 2. The plating conditions and the results obtained are given in the following Table 6.

TABLE 5

| | | |
|---|---|---|
| Composition | | |
| | $Ni(BF_4)_2$ | 100 g |
| | $H_3BO_3$ | 15 g |

TABLE 5-continued

| | | |
|---|---|---|
| | $NaH_2PO_2 \cdot 2H_2O$ | 4 g |
| | Pure Water | 1000 cc |
| Bath Condition | | |
| | Plating Bath Temperature | 25° ± 5° C |
| | pH | 3.5 |

TABLE 6

| | | Sample | | | | |
|---|---|---|---|---|---|---|
| | | 13 | 14 | 15 | 16 | 17 |
| Plating Conditions: | Electric Current Density A/dm²) | 1.0 | 1.4 | 1.7 | 2.0 | 2.5 |
| | Plating Time (sec) | 60 | 60 | 40 | 60 | 60 |
| Existence of Magnetic Character | | x | x | o | o | o |
| Coercive Force: Hc (Oe) | | — | — | 30 | 80 | 110 |
| Squareness Ratio: SQ (Br/Bs) | | — | — | 0.88 | 0.76 | 0.72 |

From these results, it can be understood that in this plating bath, a non-magnetic plated film was formed when the electric current density was 1.4A/dm² or less and a ferromagnetic plated film was formed when the density was 1.7A/dm² or more.

EXAMPLE 4

Using a plating bath containing the components given in the following Table 7, a copper base plate was plated in the same manner as described in Examples 1, 2 and 3. The plating conditions and the results are given in the following Table 8.

TABLE 7

| | | |
|---|---|---|
| Composition | | |
| | $NiSO_4 \cdot 7H_2O$ | 140 g |
| | $NiCl_2 \cdot 6H_2O$ | 40 g |
| | $NH_4Cl$ | 80 g |
| | $NaH_2PO_2 \cdot 2H_2O$ | 8 g |
| | Pure Water | 1000 cc |
| Bath Condition | | |
| | Plating Bath Temperature | 45° ± 5° C |
| | pH | 5.5 |

TABLE 8

| | | Sample | | | | |
|---|---|---|---|---|---|---|
| | | 18 | 19 | 20 | 21 | 22 |
| Plating Conditions: | Electric Current Density (A/dm²) | 0.8 | 1.2 | 1.5 | 2.0 | 2.5 |
| | Plating Time (sec) | 60 | 40 | 40 | 40 | 50 |
| Existence of Magnetic Character | | x | x | o | o | o |
| Coercive Force: Hc (Oe) | | — | — | 21 | 43 | 48 |
| Squareness Ratio: SQ (Br/Bs) | | — | — | 0.88 | 0.72 | 0.71 |

From these results, it can be understood that in this plating bath, a ferromagnetic plated film was obtained when the electric current density was 1.5A/dm² or more, and a non-magnetic plated film was obtained when the density was 1.2A/dm² or less.

EXAMPLE 5

Using a plating bath containing the components given in the following Table 9, a copper base plate was plated in the same manner as described in Examples 1, 2 and 3. The plating conditions and the results obtained are given in the following Table 10.

TABLE 9

| | | |
|---|---|---|
| Composition | | |
| | $CoSO_4 \cdot 7H_2O$ | 10 g |
| | $CoCl_2 \cdot 6H_2O$ | 5 g |
| | $H_3BO_3$ | 30 g |
| | $NaH_2PO_2 \cdot H_2O$ | 40 g |
| | Pure Water | 1000 cc |
| Bath Condition | | |
| | Plating Bath Temperature | 45° C |
| | pH | 5.5 ± 0.5 |

TABLE 10

| | | Sample | |
|---|---|---|---|
| | | 23 | 24 |
| Plating Conditions: | Electric Current Density (A/dm²) | 0.5 | 1.5 |
| | Plating Time (sec) | 30 | 10 |
| Existence of Magnetic Character | | x | o |
| Coercive Force: Hc (Oe) | | — | 280 |
| Squareness Ratio: SQ (Br/Bs) | | — | 0.71 |

From these results, it can be understood that in this plating bath, a ferromagnetic plated film was obtained when the electric current density was 1.5A/dm², and a non-magnetic plated film was obtained when the density was 0.5A/dm².

As is apparent from the results in the above Examples, where various kinds of plating bath and base metal were used, both a non-magnetic film and a ferromagnetic film can be selectively obtained in a single plating bath in every case by varying the plating conditions.

When the hardness and the surface roughness of each plated film obtained were tested, no abnormalities were found, and the plated film obtained had excellent brilliance. The effect of this invention is apparent.

EXAMPLE 6

COMPARATIVE EXPERIMENTS

Experiment I (Ni-P plating bath)

Using a plating bath containing the components given in following Table 11, the bath being provided with a nickel plate anode (nickel purity: 99.9%), a copper plate base substrate (copper purity: 99.9%; previously confirmed to be non-magnetic using a B-H tracer) plating was conducted by varying the electric current density during plating.

TABLE 11

| | | |
|---|---|---|
| Composition | | |
| | $NiSO_4 \cdot 7H_O$ | 60 g |
| | $NiCl_2 \cdot 5H_2O$ | 40 g |
| | $H_3BO_3$ | 30 g |
| | $Na_2H_2PO_2 \cdot 2H_2O$ | (refer to Table 12) |
| | Pure Water | 1000 cc |
| Bath Conditions | | |
| | Plating Bath Temperature | 45° ± 5° C |
| | pH | 4.6 ± 0.4 |

The plating conditions and the results obtained are given in the Table 12.

TABLE 12

| | | Sample | | | | | | | |
|---|---|---|---|---|---|---|---|---|---|
| | | 25 | 26 | 27 | 28 | 29 | 30 | 31 | 32 |
| Amount of $Na_2H_2PO_2 \cdot H_2O$ (g/l) | | 0.2 | 0.2 | 0.5 | 0.5 | 0.8 | 0.8 | 1.0 | 1.0 |
| Plating Conditions: | Electric Current Density(A/dm²) | 1.0 | 2.5 | 1.0 | 2.5 | 1.0 | 2.5 | 1.0 | 2.5 |
| | Plating Time (sec) | 200 | 200 | 200 | 200 | 200 | 200 | 200 | 200 |
| Existence of | | | | | | | | | |

TABLE 12-continued

| | Sample | | | | | | | |
|---|---|---|---|---|---|---|---|---|
| | 25 | 26 | 27 | 28 | 29 | 30 | 31 | 32 |
| Magnetic Character | o | o | o | o | o | o | x | o |
| Coercive Force:Hc (Oe) | 45 | 50 | 50 | 80 | 60 | 110 | — | 180 |
| Squareness Ratio: SQ (Br/Bs) | 0.84 | 0.85 | 0.85 | 0.86 | 0.86 | 0.87 | — | 0.87 |

From the results set forth in Table 12, it can be seen that when the amount of $Na_2H_2PO_2.H_2O$ was 1.0 g/l and the electric current density was 2.5A/dm$^2$ (refer to Sample 31), a non-magnetic plated film was deposited; when the amount of $Na_2H_2PO_2.H_2O$ was 1.0 g/l and the electric current density was 1.0A/dm$^2$ (refer to Sample 32), a ferromagnetic plated film was deposited; and when the amount of $Na_2PO_2.H_2O$ was less than 1.0 g/l and the electric current density was 1.0 or 2.5A/dm$^2$ (refer to Samples 25 to 30), ferromagnetic plated films were deposited.

It was thus confirmed that the amount of $Na_2H_2PO_2.H_2O$ needed was at least 1.0 g/l in order to selectively deposit a ferromagnetic or non-magnetic plated film by varying the electric current density.

Experiment II (Co-P plating bath)

Using a plating bath containing the components given in Table 13, a copper base plate was plated in the same manner as described in Experiment I. The plating conditions and the results obtained are given in Table 14.

TABLE 13

| | | |
|---|---|---|
| Composition | | |
| | $CoSO_4 . 7H_2O$ | 60 g |
| | $CoCl_2 . 5H_2O$ | 40 g |
| | $H_3BO_3$ | 30 g |
| | $Na_2H_2PO_2 . H_2O$ | (refer to Table 14) |
| | Pure Water | 1000 cc |
| Bath Conditions | | |
| | Plating Bath Temperature | 45° ± 5° C |
| | pH | 4.6 ± 0.4 |

TABLE 14

| | Sample | | | | | | | |
|---|---|---|---|---|---|---|---|---|
| | 33 | 34 | 35 | 36 | 37 | 38 | 39 | 40 |
| Amount of $Na_2H_2PO_2 . H_2O$ (g/l) | 0.2 | 0.2 | 0.5 | 0.5 | 0.8 | 0.8 | 1.0 | 1.0 |
| Plating Conditions: Electric Current Density (A/dm$^2$) | 1.0 | 2.5 | 1.0 | 2.5 | 1.0 | 2.5 | 1.0 | 2.5 |
| Plating Time (sec) | 200 | 200 | 200 | 200 | 200 | 200 | 200 | 200 |
| Existence of Magnetic Character | o | o | o | o | o | o | x | o |
| Coercive Force: Hc (Oe) | 140 | 150 | 150 | 180 | 160 | 210 | — | 280 |
| Squareness Ratio: SQ (Br/Bs) | 0.81 | 0.82 | 0.83 | 0.84 | 0.83 | 0.85 | — | 0.87 |

Experiment III (Ni-Co-P plating bath)

Using a plating bath containing the components given in Table 15, a copper base plate was plated in the same manner as described in Experiment I.

The plating conditions and the results obtained are given in Table 16.

TABLE 15

| | | |
|---|---|---|
| Composition | | |
| | $NiSO_4 . 7H_2O$ | 60 g |
| | $NiCl_2 . 5H_2O$ | 40 g |
| | $CoSO_4 . 7H_2O$ | 30 g |
| | $CoCl_2 . 5H_2O$ | 10 g |
| | $H_3BO_3$ | 30 g |
| | $Na_2H_2PO_2 . 2H_2O$ | (refer to Table 16) |
| | Pure Water | 1000 cc |
| Bath Conditions | | |
| | Plating Bath Temperature | 45° ± 5° C |
| | pH | 4.6 ± 0.4 |

TABLE 16

| | Sample | | | | | | | |
|---|---|---|---|---|---|---|---|---|
| | 41 | 42 | 43 | 44 | 45 | 46 | 47 | 48 |
| Amount of $Na_2H_2PH_2 . H_2O$ (g/l) | 0.2 | 0.2 | 0.5 | 0.5 | 0.8 | 0.8 | 1.0 | 1.0 |
| Plating Conditions: Electric Current Density (A/dm$^2$) | 1.0 | 2.5 | 1.0 | 2.5 | 1.0 | 2.5 | 1.0 | 2.5 |
| Plating Time (sec) | 200 | 200 | 200 | 200 | 200 | 200 | 200 | 200 |
| Existence of Magnetic Character | o | o | o | o | o | o | x | o |
| Coercive Force:Hc (Oe) | 185 | 190 | 195 | 230 | 200 | 260 | — | 330 |
| Squareness Ratio: SQ (Br/Bs) | 0.66 | 0.68 | 0.68 | 0.69 | 0.68 | 0.71 | — | 0.72 |

Experiments II and III provided results showing the same trend as Expermient I. Consequently, it was further confirmed that the amount of $Na_2H_2PO_2.H_2O$ needed is at least 1.0 g/l in order to selectively deposit a ferromagnetic or non-magnetic plated film by varying the electric current density when a Co-P or Ni-Co-P plating bath is used.

While the invention has been described in detail and with reference to specific embodiments thereof, it will be apparent to one skilled in the art that various changes and modifications can be made therein without departing from the spirit and scope thereof.

What is claimed is:

1. A method for electroplating in a single electroplating bath which contains nickel and cobalt as the main component and as an additional component phosphorus, said components being either ferromagnetic or non-magnetic in properties, said electroplating bath containing from about 1 to 300 g/l of nickel ions, from about 1 to 300 g/l of cobalt ions and from about 1 to 100 g/l of $NaH_2PO_2.H$ O, said method comprising varying the electric current density during plating from about 0.3A/dm$^2$ to about 10A/dm$^2$ so that a non-magnetic film is selectively deposited at one electric current density and a ferromagnetic film is selectively deposited at a second electric current density, thereby forming a plated non-magnetic film containing mainly nickel and cobalt and as an additional component phosphorus and a plated ferromagnetic film, said ferromagnetic and non-magnetic components being selectively deposited at different electric current densities.

2. The method as claimed in claim 1, wherein the films comprise grains having a size of about 500 A to about 0.1 $\mu$.

3. The method as claimed in claim 1, wherein the non-magnetic film comprises grains having a size of about 100 Å to about 0.1 $\mu$.

4. The method as claimed in claim 1, wherein the ferromagnetic film comprises grains having a size of about 500 Å to about 0.1 $\mu$.

* * * * *